United States Patent [19]

Martin et al.

[11] 4,232,721

[45] Nov. 11, 1980

[54] COLLAPSIBLE SOLUTION CONTAINER HAVING RECTANGULAR SHOULDER

[75] Inventors: Jerry D. Martin, Highland Park; Stephen J. Pearson, Ingleside; Gary A. Ward, Round Lake, all of Ill.; David A. Winchell, Twin Lakes, Wis.

[73] Assignee: Baxter Travenol Laboratories, Inc., Deerfield, Ill.

[21] Appl. No.: 28,151

[22] Filed: Apr. 9, 1979

[51] Int. Cl.[3] ..... B65D 1/02

[52] U.S. Cl. ..... 150/0.5; 222/107

[58] Field of Search ..... 150/0.5-8; 222/107; 128/DIG. 24, 214 D; D24/58

[56] References Cited

U.S. PATENT DOCUMENTS

| | | | |
|---|---|---|---|
| 3,083,877 | 4/1963 | Gash | 222/107 |
| 3,110,308 | 11/1963 | Bellamy | 128/214 D |
| 3,288,334 | 11/1966 | Corsette | 222/107 |
| 3,353,714 | 11/1967 | Trecek | 222/107 |
| 3,595,441 | 7/1971 | Grosjean | 222/107 |
| 3,993,223 | 11/1976 | Welker | 222/107 |
| 4,049,033 | 9/1977 | Ralston | 150/0.5 |

*Primary Examiner*—Donald F. Norton

*Attorney, Agent, or Firm*—Paul C. Flattery; John P. Kirby, Jr.; Garrettson Ellis

[57] ABSTRACT

A molded collapsible solution container which container defines a chamber-defining body portion wall having an integral neck portion and shoulder portion at one end thereof. The container defines, in its normal, unstressed state, a transverse cross section which tapers from the shoulder portion progressively along a major portion of its length to a flat, sealed end portion at the end of the container opposite to the one end. In accordance with this invention, the shoulder portion is rectilinear in shape, with the wall circumferences of transverse cross sections preferably progressively decreasing in length along the container from adjacent the shoulder portion toward the opposite end. Opposed triangular gusset portions are preferably present in which the side of the gusset portion which is parallel to the shoulder edge is positioned directly against the shoulder edge, and the shoulder edge defines the shape of an enlarged, generally cylindrical section for ease of flexing. Flat areas are defined in the container wall between the gussets.

36 Claims, 11 Drawing Figures

COLLAPSIBLE SOLUTION CONTAINER HAVING RECTANGULAR SHOULDER

BACKGROUND OF THE INVENTION

In U.S. Pat. Nos. 4,049,033 and 4,088,166, among others, a molded collapsible solution container is disclosed which collapses relatively easily under low suction pressures, and thus finds particularly desirable use as a container for parenteral solutions.

It is particularly desirable for the collapsibility of the container to be as complete as possible at the low suction pressures generated by, for example, a two to three foot suction head of water or a desired parenteral solution, even when the container is made of a relatively stiff polyolefin plastic or the like which customarily has not been thought of being useful for making a container which completely collapses under such a low suction pressure head.

In accordance with this invention, an improved container is provided exhibiting improved and more complete collapsibility at lower suction pressures than previous designs.

DESCRIPTION OF THE INVENTION

In accordance with this invention a molded, collapsible solution container is provided in which the container defines a chamber-defining body portion wall having an integral neck portion and a shoulder portion at one end thereof. The container defines, in its normal, unstressed, as-molded state, a transverse cross section which tapers from the shoulder portion progressively along a major portion of its length to a flat, sealed end portion at the end of the container opposite to the one end.

In accordance with this invention, the shoulder portion is rectangular in shape, with the wall circumferences of the transverse cross sections of the body portion progressively decreasing in length along the shoulder from adjacent the shoulder portion toward the opposite end. As a result, the flattened container exhibits an outward flaring from the flat tail end to the shoulder end. The structure facilitates the collapse of the container, providing room for the gusset portions to pivot outwardly to achieve an improved mode of collapse.

The preferred gusset portions may be positioned in opposed relation to each other, and made to define three sides in triangular relation, one of the sides of each of the gusset portions being generally parallel to the opposed shoulder edges adjacent which the gussets are positioned.

Preferably, the side of each gusset portion which is parallel to the shoulder edge is positioned directly on the shoulder edge, to constitute a common member with the shoulder edge. Alternatively, the parallel side of the gusset portion may be recessed under the shoulder edge as shown, for example, in U.S. Pat. No. 4,088,166.

The rectangular shoulder portion also defines a second pair of opposed shoulder edges which are in generally normal relation to the opposed shoulder edges that are parallel to the opposed gusset portions.

A pair of opposed lines of flexing weakness are defined in the collapsible solution container, and each exhibits an arcuate cross section. The opposed lines of flexing weakness are positioned on each side of the container in parallel relation to the second pair of shoulder edges, being preferably spaced from the shoulder edges in the direction of the flat, sealed end portion by a distance of no more than one fourth of the length of the container, as measured from the shoulder portion to the flat, sealed end portion, and preferably longitudinally positioned generally adjacent to the rear apexes of the gussets.

Preferably, each of the second shoulder edges and the parallel lines of weakness define respective areas between them in the container wall which are essentially planar in their original, unstressed condition.

Preferably, the container of this application defines a convex, arcuate seal line adjacent its flat, sealed end for improved strength.

It is also preferable for the transverse cross-sections of the container along the majority of its length, beginning adjacent the shoulder portion, to exhibit mutually perpendicular major and minor transverse axes with the major axes being longer than the minor axes. A pair of opposed, outwardly-angled wall portions, each defining a generally acutely-angled apex, may be positioned on the major axes.

Furthermore, the same transverse cross-sections may preferably exhibit generally planar central areas adjacent the minor transverse axes.

As a specific, potentially useful characteristic of the container of this invention, when it has collapsed to its almost completely collapsed configuration, the rate of draining of the container at a constant suction pressure head decreases substantially, but does not completely terminate, for a significant period of time. Accordingly, the container may be designed for parenteral solution therapy with the 1000 ml. or other desired dosage capacity, but also with a small amount (for example 50 cc.) of extra capacity of parenteral solution. Accordingly, the bag can be designed so that about 900 cc. of parenteral solution can be administered normally, but in the event that the nurse does not arrive at that time, the administration flow does not altogether cease, but merely slows down for the last 150 cc. or so, with the result that clotting of the needle is prevented, as takes place when no flow is passing through the administration set. At the same time, because of the reduced flow following the administration of the basic amount of solution, there is no serious overdose of the patient.

Referring to the drawings.

Figure 2:
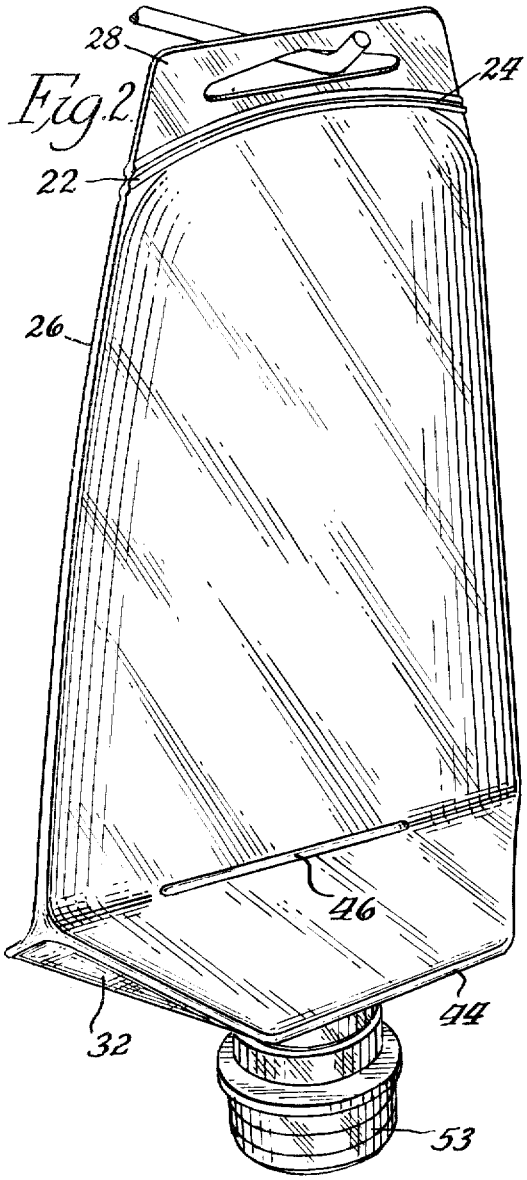
FIG. 2 is a perspective view of the container of this invention in collapsed configuration.

Referring to the drawings, the molded, collapsible solution container 10 of this invention is shown positioned within the pair of mold halves 12, 14 which are used in conjunction with conventional blow-molding apparatus for the manufacture of the containers of this invention.

Container 10 has a chamber-defining body portion wall 16, and an integral neck portion 18 adapted for receiving a conventional sterile-seal closure for parenteral solution containers, and a shoulder portion 20.

Figure 4:
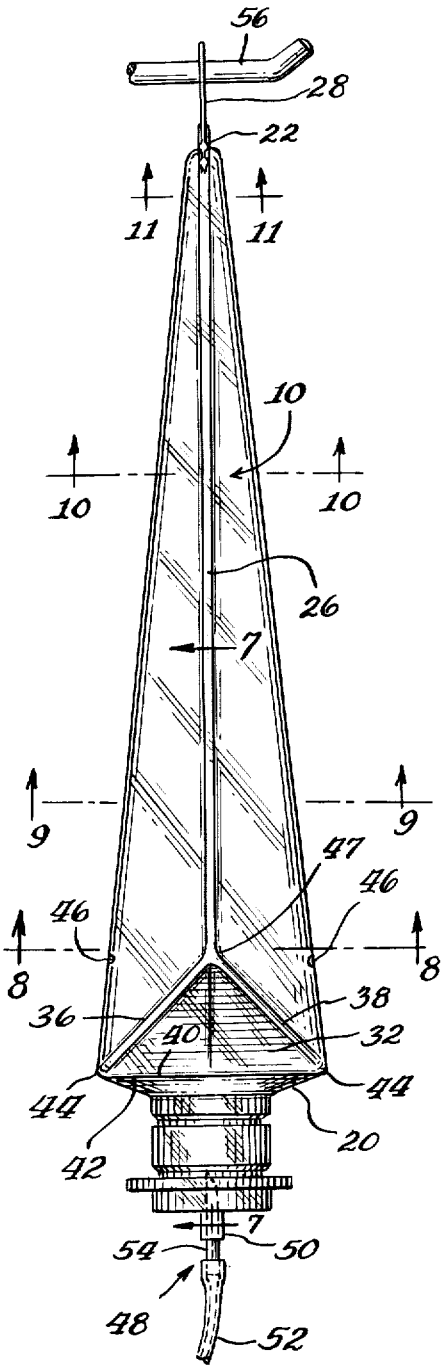
FIG. 4 is an elevational view of the container of this invention in its initial, unstressed configuration.

As in the previously cited patents, the container may define, in its normal, unstressed state, a transverse cross-section which tapers from the shoulder portion 20, as shown for example in FIG. 4, progressively along a major portion of its length to a flat, sealed end portion 22 at the end of the container opposite to the one end which carries the shoulder portion. Preferably, the tapering begins at the shoulder portion 20, and proceeds in generally continuous manner to the sealed end 22.

The specific design of sealed end 22 may be in accordance with the method and design described in U.S. Pat. Nos. 4,105,730 and/or 4,076,063, or a simple double bar end seal may be used.

End 22 of container 10 further defines a convex, arcuate seal line 24, adjacent to and as part of the flat, sealed end 22. The convex, arcuate configuration of the seal line 24 provides improved strength to the seal, which is particularly desirable as in the specific embodiment involving thin sheets of preferably oriented plastic material, which is generally difficult to seal in a reliable and strong manner.

The wall thickness of the container of this application may preferably be about 0.01 to 0.02 inch in thickness, and is generally uniform about the entire chamber-defining body portion 16 of the container, while the neck portion 18 is typically of greater wall thickness so as to be relatively stiff. Shoulder portion 20 is desirably as thin as body portion 16 about its edges, and is thicker at central portions thereof, for example about 0.03 inch thick.

A thin line of flexing weakness 26 of arcuate cross-section may be defined in opposed relation along the longitudinal edges of the container, as shown in the drawings, to facilitate the flat collapse along the length of the bag.

The flat end 22 defines a flat extension 28 which may be utilized as a hanger member, as shown in FIG. 2, for example.

In accordance with this invention, the shoulder portion 20 may be rectangular in shape. Furthermore, as specifically shown in FIG. 7, the various transverse cross-sections exemplified at 30 of the container exhibit wall circumferences which progressively decrease in length along the container from adjacent the shoulder portion 20 toward the opposite end 22 thereof. Accordingly, the collapsed container exhibits a taper from the shoulder to the other end which has been found to be beneficial in providing a flat, planar collapse, rather than collapsing flat to a generally non-planar, slightly buckled structure, as in the prior art.

This provides a significant advantage of permitting the collapsed bags, prior to filling, to receive printing on the face of the bag itself to function as a label, with volume indicia for indicating the amount of liquid withdrawn from the bag, or any other desired information.

As a further contribution to the planar configuration that most of the bag can occupy, (with the exception of the shoulder and neck portions and end 22) in its collapsed configuration, the bag tapers uniformly from the shoulder end 20 to the tail end 24 without the use of a non-tapered section in body wall portion 16, as has been shown in the prior art.

Other examples of the tapered cross-section are shown in FIGS. 2 through 11.

Figure 6:
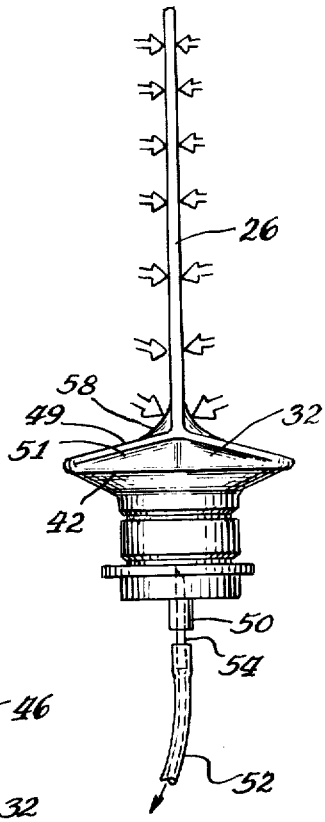
FIG. 6 is a fragmentary elevational view of the container of this invention, showing it in essentially completely collapsed configuration, as the last of the liquid contents is being drained from it.
Figure 7:
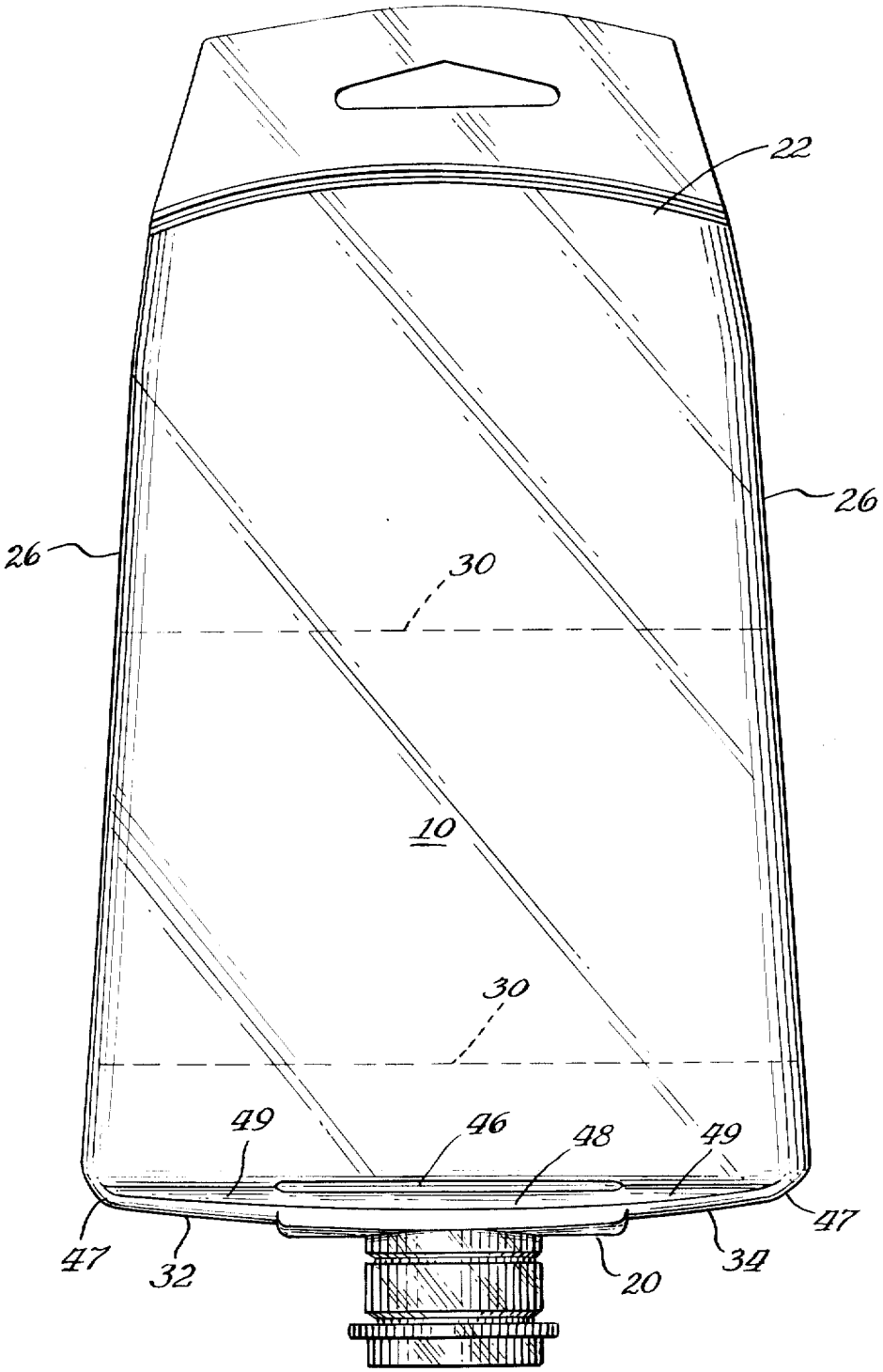
FIG. 7 is an elevational view, rotated 90° about the longitudinal axis from the view of FIG. 6, showing the container of this invention in essentially completely collapsed configuration.

The collapsible container of this invention may also define gusset portions 32, 34, which facilitate the outward spreading of the container wall adjacent shoulder 20 on the axis between the gussets (as shown in FIG. 7), while the container simultaneously collapses inwardly from the viewpoint of the axis perpendicular to the axis between the gussets 32, 34 (as shown in FIG. 6).

The gussets 32, 34 are positioned in opposed relation to each other on opposite sides of the bag adjacent the shoulder portion, at opposed ends thereof. The gusset portions 32, 34 include lines of weakness to facilitate the collapse of the container adjacent the shoulder portion as the contents are withdrawn. These lines include lines 36 and 38 which may be lines of arcuate cross-section, similar to lines 26, to facilitate flexing.

Each gusset portion 32, 34 is a triangular structure defining three sides, i.e., sides 36, 38 and 40, side 40 of the gusset defining a line which is parallel to the corresponding shoulder edge 42 and preferably, as shown, is coextensive with shoulder edge 42.

Shoulder edge 42 may alternatively define the shape of an enlarged, generally cylindrical section to permit flexing motion of its associated gussets 32, 34 into the outspread relationship of the gussets to the shoulder 20 as shown in FIG. 7. However, as shown, shoulder edge 42 simply defines an angled line surface to form a relatively sharp corner.

Shoulder 20 also defines a second pair of opposed shoulder edges 44, which may preferably be of relatively enlarged, generally cylindrical section construction, typically of 0.05 to 0.3 inch diameter, extending between the gussets.

The above fold lines of the shoulder edges, the gussets, and elsewhere may specifically be of the cross-sectional shape as defined in U.S. Pat. No. 4,090,541 for desired flexing characteristics.

A pair of opposed lines of flexing weakness 46 is defined in the container of this invention. Lines 46 exhibit an arcuate cross-section to facilitate flexing of the material, the cross-sectional diameter of said lines being preferably from 0.05 to 0.2 inch and specifically about 0.1 inch.

The opposed lines of flexing weakness 46 are positioned on each side of the container in parallel relation to the second pair of shoulder edges 44, being preferably spaced from the shoulder edges in the direction of the flat, sealed end portion by a distance of one sixteenth to one quarter of the length of the container, as measured from the shoulder portion 20 to the flat, sealed end portion 22 and preferably adjacent to but typically about 0.05 to 0.2 inch displaced toward end 24 from a line extending between the apexes of each gusset 32, 34, typically being so displaced about 0.1 inch. For a container which measures about 10 inches between the shoulder edges 42 and the beginning of the flat, sealed end portion 22, opposed lines of flexing weakness 46 may be positioned about 1 or 2 inches from the shoulder edges 44, and specifically about 1.3 inches.

Preferably, each of the second shoulder edges 44 and its associated parallel line of flexing weakness 46 defines an area 48 between them in the container which is essentially planar in the original, unstressed, as-molded condition of the container. Each planar area 48 may be roughly rectangular in shape in the embodiment as shown, in which the lines of folding weakness 46 are each positioned centrally and transversely on the container, and are of approximately equal length to shoulder edges 44.

In other words, line 46 is positioned at approximately the same axial position of bag 10 as the apexes 47 of each gusset. Also, preferably, line 46 is of a length corresponding to edge 44 of shoulder 20 so as to define the rectangular planar area 48, and also to define triangular areas 49 on each side of each rectangular area 48, which are each of a shape and area equal to a triangular half 51 of its adjacent gusset 32, 34 as shown for example in FIG. 3. Accordingly, when the container folds, each triangular area 49 can fold up against one half of its adjacent gusset 32, 34 for a flat, efficient fold.

Furthermore, in the collapsed condition as shown in FIG. 7, the distance between apexes 47 of the gussets is preferably equal to one half of the circumference of body 10 in the cross section that defines the two apexes 47. This further facilitates flat folding.

Also, it should be noted that line of weakness 46 defines an inwardly extending arc, while the other lines of weakness in the container preferably define outwardly extending arcs.

Referring specifically to FIGS. 8 through 11, the tapering cross section of the container of this invention, in its as-molded, original, unstressed configuration can be seen.

Specifically, it can be seen that along the majority of the length of the container, beginning adjacent the shoulder portion, the cross sections (specifically the cross sections of FIGS. 8 through 10) exhibit mutually perpendicular major axes 60 and minor axes 62 in which the major axes are longer than the minor axes. In each cross section, there is seen a pair of opposed, outwardly angled wall portions each of which define a generally acutely angled apex 64, 66 molded into the bag, which facilitates the flat collapse of the bag. The two apexes 64, 66 are both positioned on major axis 60.

Figure 8:
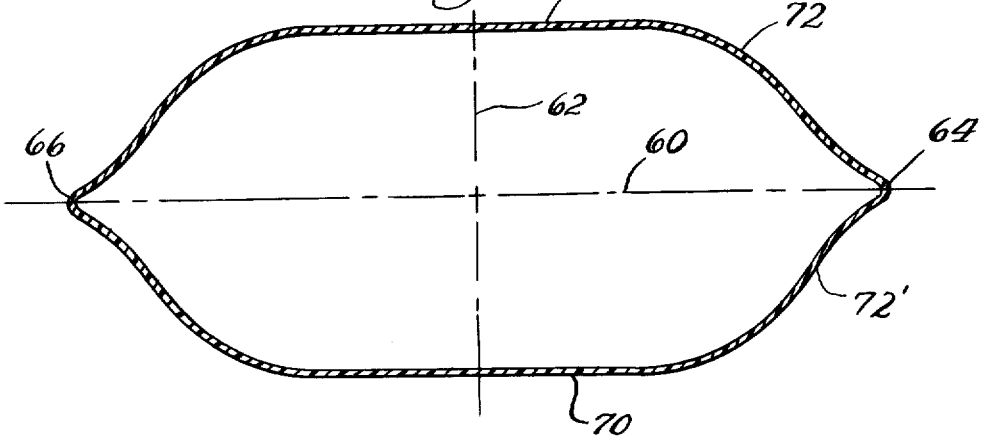
FIG. 8 is a transverse sectional view taken along line 8—8 of FIG. 4.
Figure 9:
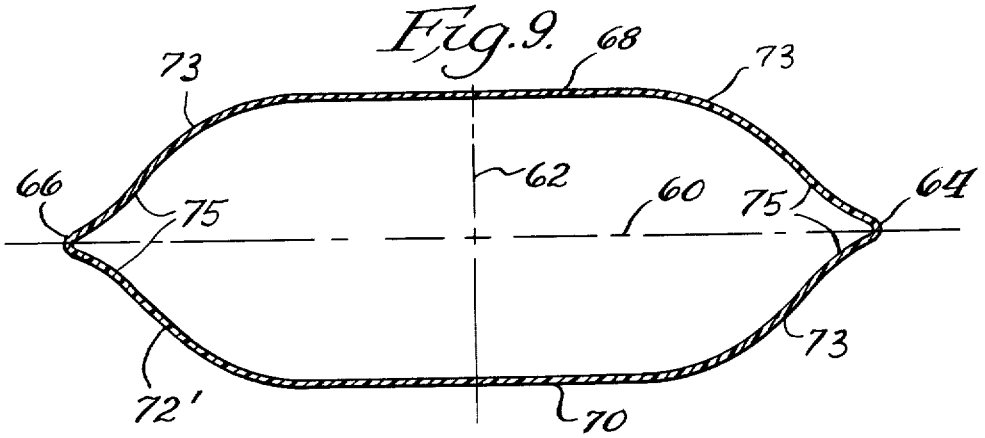
FIG. 9 is a transverse sectional view taken along line 9—9 of FIG. 4.
Figure 10:
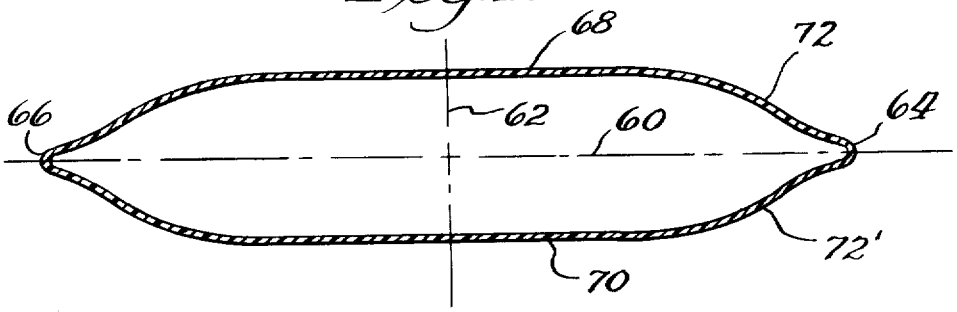
FIG. 10 is a transverse sectional view taken along line 10—10 of FIG. 4.

Furthermore, the majority of transverse cross sections (as shown in FIGS. 8 through 10) exhibit generally planar central areas 68, 70 adjacent the minor transverse axes 62.

At the generally lateral portions of the bag, curved outwardly angled wall portions 72, 72' are defined between the generally planar portions 68, 70 and apexes 64, 66 of the general shape as shown in the drawings. Curved portions 72, 72' define a convex portion 73 (FIG. 9) adjacent to generally planar central areas 68, 70, and concave portions 75 adjacent to each generally acutely-angled apex 64, 66.

Figure 11:
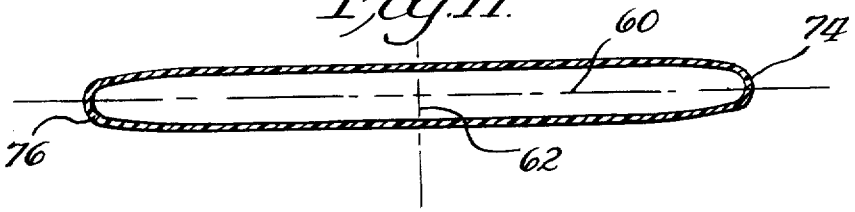
FIG. 11 is a transverse sectional view taken along line 11—11 of FIG. 4.

The tail end of bag 10, as shown in FIG. 11, may exhibit more rounded peripheral areas 74, 76 adjacent major axes 60 if desired. Alternatively, the apexes 64, 66 may continue the entire distance to the seal line 24.

Figure 1:
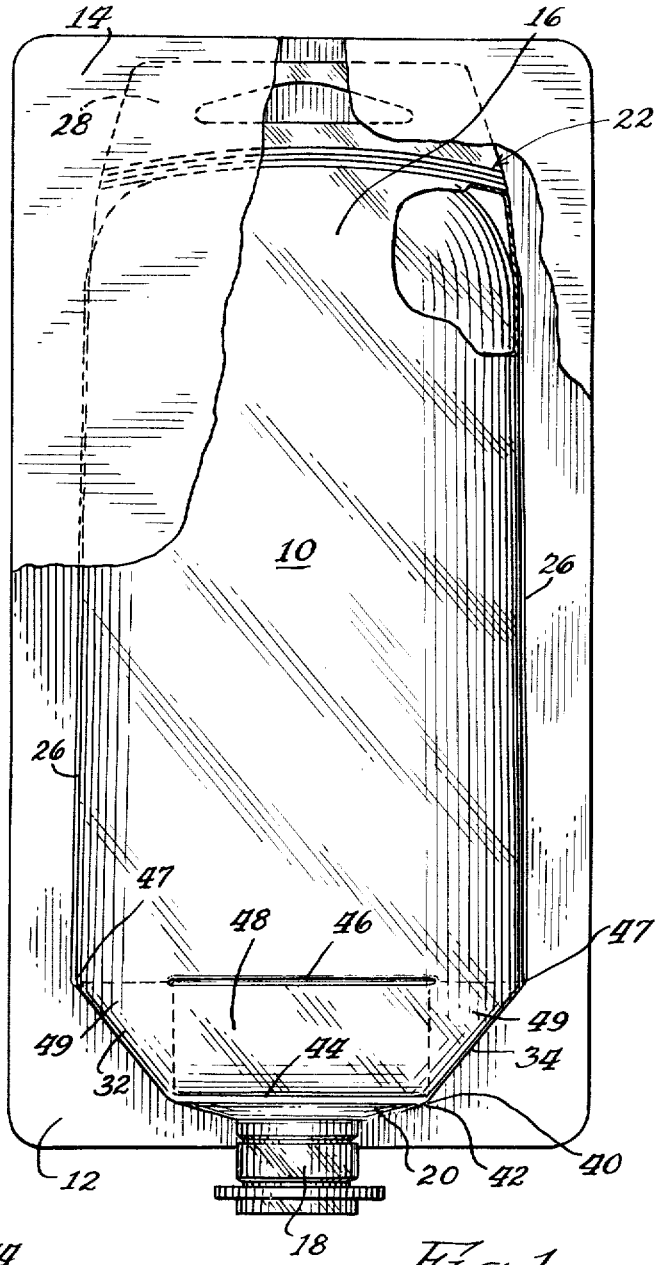
FIG. 1 is an elevational view of the container of this invention shown in its mold halves which form it, with portions of the nearer mold half being broken away.
Figure 3:
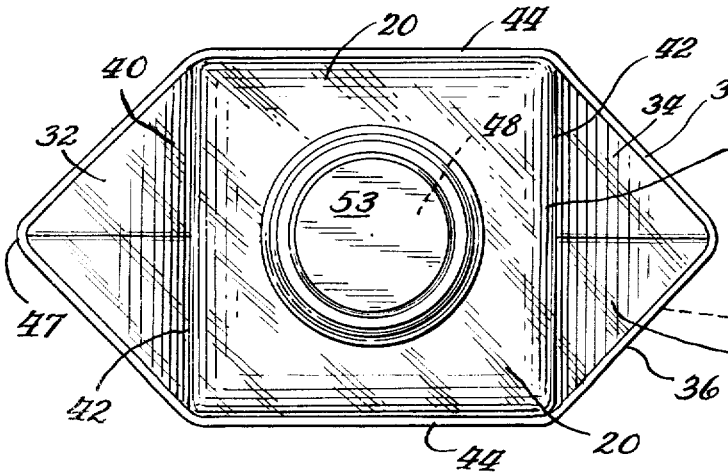
FIG. 3 is a plan view of the container of this invention in its initial, unstressed configuration.

It should also be noted that apexes 64, 66 define the thin lines of flexing weakness 26 described previously and shown, for example, in FIGS. 1 and 2.

The above configuration shown in FIGS. 8 through 11 further facilitates the flat collapse of the container which permits, for example, the direct printing of a label on the container prior to filling.

The container of this invention may be filled with parenteral solution and sealed with a conventional sterile seal which is typified by sterile seal 48 as shown, having a sealing cover 53 and tubular access member or members 50, generally with a piercable diaphragm within the access member.

A conventional solution set 52, having a piercing spike 54, may penetrate the tubular access member 50 for access to the container, which container may be placed upon a hanger 56, for example an IV pole or the like.

Figure 5:
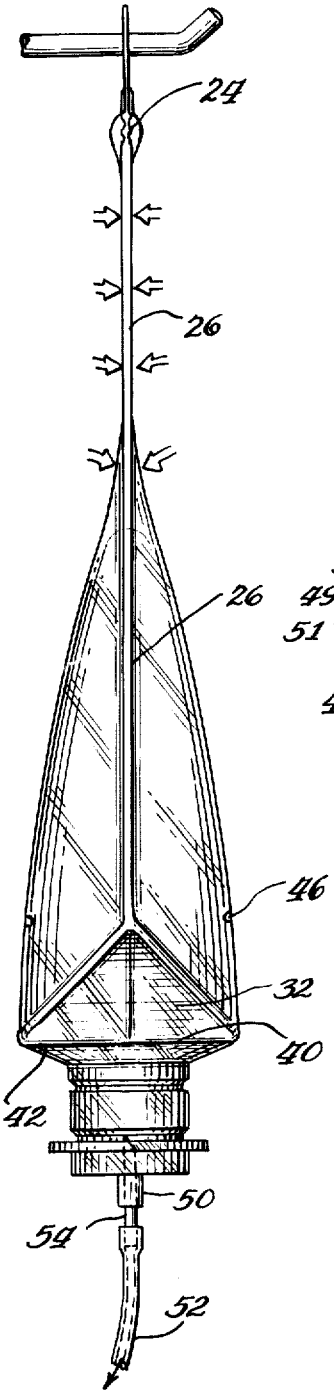
FIG. 5 is an elevational view similar to FIG. 4, showing the container in partially collapsed configuration as liquid is removed through the neck of the container.

As in conventional IV solution therapy, container 10 may be hung in inverted position, approximately two to three feet or more above the patient, to provide sufficient gravity pressure to administer the solution and also to cause the collapse of the container as the solution is drained. FIG. 5 shows the partial collapse of the container, with the walls of the container flexing into flat configuration along lateral lines of weakness 26.

As the container is completely drained, and as shown in FIGS. 6 and 7, gussets 32, 34 fold outwardly while central portions 58 of the bag wall collapse inwardly, with the lines of flexing weakness 36, 38 and shoulder edges 42, 44 flexing to permit this motion.

The improved mode of collapse of the container of this application permits the use of less air in the container to provide a meniscus to read the remaining liquid level in the container.

The above has been offered for illustrative purposes only, and is not intended to limit the invention of this application, which is as defined in the claims below.

That which is claimed is:

1. In a molded, collapsible solution container, which container defines a chamber-defining body portion wall having an integral neck portion and a shoulder portion at one end thereof and defining, in its normal, unstressed state, a transverse cross-section which tapers from said shoulder portion progressively along a major portion of its length to a flat, sealed end portion at the end of the container opposite to said one end, the improvement comprising, in combination:

said shoulder portion being rectangular in shape, the wall circumferences of said transverse cross-sections progressively decreasing in length along said container from adjacent said shoulder portion toward said opposite end, in which the transverse cross-sections of said container along the majority of its length beginning adjacent said shoulder portion exhibit mutually perpendicular major and minor transverse axes, said major axes being longer than the minor axes, and two pairs of outwardly-angled wall portions, each pair of wall portions defining a generally acutely angled apex connection together, said apex connections being positioned on said major axes, the transverse cross sections of said container along a majority of its length beginning adjacent said shoulder portion exhibiting generally planar central areas adjacent said minor transverse axes.

2. The container of claim 1 which defines a convex, arcuate seal line adjacent its flat, sealed end.

3. The container of claim 1 in which said wall circumferences decrease in a generally uniform manner along said container.

4. In a molded, collapsible solution container, which container defines a chamber-defining body portion wall having an integral neck portion and a shoulder portion at one end thereof, and defining, in its normal, unstressed state, a transverse cross-section which tapers from said shoulder portion progressively along a major portion of its length to a flat, sealed end portion at the end of the container opposite to said one end, said container also defining a pair of opposed gusset portions adjacent said shoulder portion at opposite ends thereof, said gusset portions including lines of flexing weakness to facilitate collapse of said container adjacent said shoulder portion as the contents thereof are withdrawn, said gusset portions each defining three sides in triangular relation, one of said sides of each of said gusset portions being parallel and adjacent to an opposed shoulder edge, the improvement comprising, in combination:

said shoulder portion being rectangular in shape, the wall circumferences of said transverse cross-sections progressively decreasing along said container from adjacent said shoulder portion toward said opposite end, one of the sides of each of the gusset portions being identical with one of two opposed shoulder edges, said opposed shoulder edges each comprising an angled, relatively sharp-cornered edge, said shoulder portion also defining a second opposed pair of shoulder edges extending between said gusset portions, said second pair of shoulder edges defining the shape of a relatively enlarged, generally cylindrical section.

5. The container of claim 4 in which said wall circumferences decrease in a generally uniform manner along said container.

6. The container of claim 4 which defines a convex, arcuate seal line adjacent its flat, sealed end.

7. The molded, collapsible container of claim 4 in which a pair of opposed lines of flexing weakness are defined in said collapsible solution container and exhibit an arcuate cross section, said opposed lines of flexing weakness being positioned on each side of the container in parallel relation to the pair of shoulder edges which are intermediately positioned between the opposite ends of the shoulder portion associated with said gussets, said opposed lines of flexing weakness being spaced from the shoulder edges in the direction of the flat, sealed end portion.

8. The molded, collapsible solution container of claim 7 in which said gusset portions each define an apex spaced from said shoulder portion, the opposed lines of flexing weakness being longitudinally positioned adjacent to the apexes of said gusset portions.

9. The molded, collapsible solution container of claim 8 in which a portion of said body wall positioned between each opposed line of flexing weakness in the solution container and its adjacent shoulder edge is essentially planar in its original, unstressed configuration.

10. The molded, collapsible solution container of claim 9 in which, adjacent each side of said planar area, there is defined between said planar area and a side of each gusset a triangular area which is essentially equal in shape and size to a half-triangular portion of said gusset.

11. The molded, collapsible solution container of claim 10 in which the transverse cross sections of said container along the majority of its length beginning adjacent said shoulder portion exhibit mutually perpendicular major and minor transverse axes, said major axes being longer than the minor axes, and a pair of opposed, outwardly-angled wall portions each defining a generally acutely-angled apex positioned on said major axis.

12. The molded, collapsible solution container of claim 11 in which said transverse cross sections of said container along a majority of its length beginning adjacent said shoulder portion exhibit generally planar central areas adjacent said minor transverse axes.

13. In a molded, collapsible solution container, which container defines a chamber-defining body portion wall having an integral neck portion and a shoulder portion at one end thereof and defining, in its normal, unstressed state, a transverse cross-section which tapers from said shoulder portion progressively along a major portion of its length to a flat, sealed end portion at the end of the container opposite said one end, said container also defining a pair of opposed gusset portions adjacent said shoulder portion at opposite ends thereof, said gusset portions including lines of flexing weakness to facilitate collapse of said container adjacent said shoulder portion as the contents thereof are withdrawn, said gusset portions each defining three sides in triangular relationship, the improvement comprising, in combination: one of said sides of each gusset portion being positioned at one of a first pair of opposed shoulder edges, and defining an apex opposed to said one side, said shoulder portion being rectangular in shape and defining a second pair of opposed shoulder edges in generally normal relation to the first pair of opposed shoulder edges, and a pair of opposed lines of flexing weakness defined in said collapsible container and exhibiting an arcuate cross-section, said opposed lines of flexing weakness being positioned on each side of said container in parallel relation to said second pair of shoulder edges and longitudinally spaced from said shoulder edges in the direction of the flat, sealed end portion by a distance essentially equal to the longitudinal distance of each apex from the shoulder, said opposed lines of flexing weakness occupying only a central portion of the container wall, being laterally spaced from each apex.

14. The container of claim 13 in which each of said second shoulder edges and a parallel line of weakness define respective areas between them in the container wall which are essentially planar in their original, unstressed condition.

15. The container of claim 14 in which said parallel lines of flexing weakness are positioned centrally and transversely on said container and are of essentially equal length to the second pair of shoulder edges, said planar area defined between each of the second shoulder edges and its associated line of flexing weakness being essentially rectilinear in shape.

16. The container of claim 15 in which said lines of flexing weakness define an arcuate cross-section having a width of 0.05 to 0.2 inch.

17. The container of claim 16 in which said container defines transverse cross-sections having wall circumferences which progressively decrease along said container from adjacent said gusset portions toward said opposite end.

18. The container of claim 17 in which said wall circumferences decrease in a generally uniform manner along said container.

19. The molded, collapsible solution container of claim 18 in which, adjacent each side of said planar area, there is defined between said planar area and a side of each gusset a triangular area which is essentially equal in shape and size to a half-triangular portion of said gusset.

20. The container of claim 19 which defines a convex, arcuate seal line adjacent its flat, sealed end.

21. The solution container of claim 13 in which the first pair of opposed shoulder edges each comprises an angled surface to form a relatively sharp corner while the second pair of opposed shoulder edges is of relatively enlarged, generally cylindrical section construction.

22. The molding collapsible solution container of claim 21 in which the lines of flexing weakness of said gusset portions which connect with the apex define relatively enlarged generally cylindrical sections.

23. The molded collapsible solution container of claim 13 in which said opposed lines of flexing weakness are positioned adjacent to but spaced from 0.05 to 0.2 inch away from the integral neck portion from a line extending between the two apexes of the separate gusset portions.

24. In a molded, collapsible solution container, which container defines a chamber-defining body portion wall having an integral neck portion and a shoulder portion at one end thereof and defining, in its normal, unstressed state, a transverse cross-section which tapers from said shoulder portion progressively along a major portion of its length to a flat, sealed end portion at the end of the container opposite to said one end, the improvement comprising, in combination:

said shoulder portion being rectangular in shape, the wall circumferences of said transverse cross-section progressively decreasing in length along said container from adjacent said shoulder portion toward said opposite end, the transverse cross-sections of said container along the majority of its length beginning adjacent said shoulder portion exhibiting mutually perpendicular major and minor transverse axes, said major axes being longer than the minor axes, and a pair of opposed, outwardly-angled wall portions, each defining a generally acutely angled apex positioned on said major axis, said transverse cross-sections of said container along a majority of its length beginning adjacent said shoulder portion also exhibiting generally planar central areas adjacent said minor transverse axes.

25. In a molded, collapsible solution container, which container defines a chamber-defining body portion wall having an integral neck portion and a shoulder portion at one end thereof and defining, in its normal, unstressed state, a transverse cross section which tapers from said shoulder portion progressively along a major portion of its length to a flat, sealed end portion at the end of the container opposite said one end, said container also defining a pair of opposed gusset portions adjacent said shoulder portion at opposite ends thereof, said gusset portions including lines of flexing weakness to facilitate collapse of said container adjacent said shoulder portion as the contents thereof are withdrawn, said gusset portions each defining three sides in triangular relationship, the improvement comprising, in combination:

one of said sides of each gusset portion being positioned at one of a first pair of opposed shoulder edges, each gusset portion defining an apex opposed to said one side, said shoulder portion being rectangular in shape and defining a second pair of opposed shoulder edges in generally normal relation to said first pair of opposed shoulder edges, and a pair of opposed lines of flexing weakness defined in said collapsible solution container and exhibiting an arcuate cross-section which extends inwardly of said container, said opposed lines of flexing weakness being positioned on each side of said container in parallel relation to said second pair of shoulder edges, being laterally spaced from the apexes of said gussets and longitudinally spaced from said shoulder edges in the direction of the flat, sealed end portion by a distance essentially equal to the longitudinal distance of each apex from the shoulder, said parallel lines of flexing weakness being of essentially equal length to the second pair of shoulder edges.

26. The molded collapsible solution container of claim 25 in which said parallel lines of flexing weakness and the second pair of shoulder edges define respectively a pair of essentially rectangular areas between them, and in which, adjacent each side of said rectangular area, there is defined between said rectangular area and a side of each gusset a triangular area which is essentially equal in shape and size to a half-triangular portion of said gussets.

27. The container of claim 26 which defines a convex, arcuate seal line adjacent its flat, sealed end.

28. The molded collapsible solution container of claim 25 in which said opposed lines of flexing weakness are positioned adjacent to but spaced from 0.05 to 0.2 inch away from the integral neck portion from a line extending between the two apexes of the separate gusset portions.

29. In a molded, collapsible solution container, which container defines a chamber-defining body portion wall having an integral neck portion and a shoulder portion at one end thereof and defining, in its normal, unstressed state, a transverse cross-section which tapers from said shoulder portion progressively along a major portion of its length to a flat, sealed end portion at the end of the container opposite to said one end, said container also defining a pair of opposed gusset portions adjacent said shoulder portion at opposite ends thereof, said gusset portions including lines of flexing weakness to facilitate collapse of said container adjacent said shoulder portion as the contents thereof are withdrawn, said gusset portions defining three sides in triangular relation, the improvement comprising, in combination:

said shoulder portion being rectangular in shape, and the transverse cross-sections of said container along the majority of its length beginning adjacent said gusset portions exhibit mutually perpendicular major and minor transverse axes, said major axes being longer than the minor axes, the transverse cross-sections of said container along a majority of its length exhibiting generally planar central areas adjacent said minor transverse axes.

30. The molded collapsible solution container of claim 29 in which two pairs of outwardly-angled wall portions each define a generally acutely angled apex connection together positioned on the major axis and each wall portion defines a concave wall section on each side of each acutely-angled apex, and convex wall sections between said concave wall sections and the planar central areas.

31. The molded, collapsible solution container of claim 30 which defines a convex, arcuate seal line adjacent its flat, sealed end.

32. In a molded, collapsible solution container which container defines chamber-defining body portion wall having an integral neck portion and a shoulder portion at one end thereof defining, in its normal, unstressed state, a transverse cross-section which tapers from said shoulder portion progressively along a major portion of its length to a flat, sealed end portion at the end of the container opposite to said one end, said container also defining a pair of opposed gusset portions adjacent said shoulder portion at opposite ends thereof, said gusset portions including lines of flexing weakness to facilitate collapse of said container adjacent said shoulder portion as the contents thereof are withdrawn, said gusset portions each defining three sides in triangular relation, the improvement comprising, in combination:

one of said sides of each gusset portion being positioned at one of a first pair of opposed shoulder edges, each gusset portion defining an apex opposed to said one side, said shoulder portion being rectangular in shape and defining a second pair of opposed shoulder edges in generally normal relation to said first pair of opposed shoulder edges, and a pair of opposed lines of flexing weakness defined in said collapsible solution container and exhibiting an arcuate cross-section which extends inwardly of said container, said opposed lines of flexing weakness being positioned on each side of the container in parallel relation to said second pair of shoulder edges, being laterally spaced from the apexes of said gussets, and longitudinally spaced from said shoulder edges in the direction of the flat, sealed end portion by a distance essentially equal to the longitudinal distance of each apex from the shoulder, said parallel lines of flexing weakness being of essentially equal length to the second pair of shoulder edges to define respectively between each parallel line of flexing weakness and each of the second shoulder edges a pair of essentially rectangular areas between them, and in which, adjacent each side of said rectangular area, there is defined between said rectangular area and a side of each gusset a triangular area which is essentially equal in shape and size to a half-triangular portion of the adjacent gusset, the first pair of opposed shoulder edges defining an angled surface to form a relatively sharp corner, while the second pair of opposed shoulder edges is of relatively enlarged, generally cylindrical section construction and in which the lines of flexing weakness of said gusset portions which connect with the apex define relatively enlarged, generally cylindrical sections, the transverse cross-sections of said container along the majority of its length beginning adjacent said gusset portions exhibiting mutually perpendicular major and minor transverse axes, said major axes being parallel to said second shoulder edges and longer than the minor axes, and two pairs of outwardly angled wall portions, each pair of wall portions defining a generally acute-angled apex connection together and positioned on said major axis, the transverse cross-sections of said container along a majority of its length also exhibiting generally planar central areas adjacent said minor transverse axes, and further in which the outwardly-angled wall portions each define a concave wall section on each side of each acutely-angled apex.

33. The molded collapsible solution container of claim 32 which defines a convex, arcuate seal line adjacent its flat, sealed end.

34. The molded collapsible solution container of claim 32 in which the essentially rectangular areas defined between the shoulder edges and parallel lines of flexing weakness are essentially planar.

35. The molded collapsible solution container of claim 32 in which said parallel lines of flexing weakness define an arcuate cross-section having a width of 0.05 to 0.2 inch.

36. The molded collapsible solution container of claim 33 in which said opposed lines of flexing weakness are positioned adjacent to but spaced from 0.05 to 0.2 inch away from the integral neck portion from a line extending between the two apexes of the separate gusset portions.

* * * * *